US005118108A

United States Patent [19]

Wilmoth, III

[11] Patent Number: 5,118,108

[45] Date of Patent: Jun. 2, 1992

[54] POLICE BATON WITH HAND GUARD AND TRAPPING TIP

[76] Inventor: Clark L. Wilmoth, III, 40 Ximeno Ave., #3, Long Beach, Calif. 90803

[21] Appl. No.: 637,336

[22] Filed: Jan. 3, 1991

[51] Int. Cl.[5] ..... F41B 15/02

[52] U.S. Cl. ..... 273/84 R

[58] Field of Search ..... 273/67 R, 67 DA, 67 DB, 273/81 R, 81.4, 81.3, 84 R, 84 A, 84 ES; 30/295; 135/72; D8/80, 97

[56] References Cited

U.S. PATENT DOCUMENTS

| | | | |
|---|---|---|---|
| 1,260,007 | 3/1918 | Maluf | 30/295 |
| 3,109,653 | 11/1963 | Biggs | 273/81.3 |
| 3,385,601 | 5/1968 | Black | 273/84 R |
| 4,132,409 | 1/1979 | Taylor | 273/84 R |
| 4,283,051 | 8/1981 | Perez | 273/84 R |
| 4,949,966 | 8/1990 | Bopp | 273/84 R X |

OTHER PUBLICATIONS

"Merlin", Sports Illustrated, Jul. 9, 1990.

*Primary Examiner*—William H. Grieb

*Assistant Examiner*—William M. Pierce

*Attorney, Agent, or Firm*—Edward A. Sokolski

[57] ABSTRACT

An elongated cylindrical club portion has a hand guard which with the handle of the club portion forms a generally rectangular configuration at one end of the baton. The hand guard includes a trapping member forming an end wall of the guard which has a trapping tip extending beyond the hand guard perimeter. This trapping member is adjacent to and extends angularly towards the club portion and operates in conjunction with the club portion to facilitate the trapping of portions of an an opponent's body as well as bats and other such weapons. The handle further has an indentation formed therein to facilitate the gripping thereof. A side guard extends from the club portion handle. This side guard protects the user's hand and enables a more secure and more controllable grip. The side guard has a rotatable bushing installed therein which facilitates rotation of the baton. The side guard in conjunction with the rotatable bushing can be used to rapidly change the user's hand position on the baton as may be required.

5 Claims, 1 Drawing Sheet

POLICE BATON WITH HAND GUARD AND TRAPPING TIP

BACKGROUND OF THE INVENTION

1. Field of the Invention

This invention relates to police batons and more particularly to such a baton which can be utilized not only as a club but also a trapping device for restraining individuals or trapping weapons.

2. Description of the Related Art

Modern police batons must be designed not only to adequately subdue an assailant but also to defend against weapons such as bats and sticks. In addition, the baton also should be capable of enabling the police officer to restrain opponents in a manner which causes as little physical injury to such persons as possible. A good baton should also be as maneuverable as possible to enable the user to rapidly change its position before and during a confrontation. A good baton also should provide an adequate hand guard for the user's hand. Additionally, a good baton should be compatible with the natural defensive reactions of the user and should not require one to learn movements that do not come naturally to effect its proper use.

Various prior art batons have been designed with one or more of these objectives in mind. U.S. Pat. No. 3,385,601 issued May 28, 1968 to Black describes a billy club having a hand guard for protecting the user's hands. This club, however, has no special features for facilitating the restraint of an opponent or the trapping of an assailant's weapon. Further, no special features are incorporated into this club for enhancing the maneuverability thereof. U.S. Pat. No. 4,667,958 issued May 26, 1987 to Raitto and U.S. Pat. No. 4,132,409 issued Jan. 2, 1979 to Taylor describe police batons having cross handles which extend at right angles to the club portion of the baton, such cross handles being described as useful in restraining opponents. These cross handled batons are inefficient as trapping/restraining devices due to the right angle of the crosshandle in view of the fact that an opponent's arms and legs tend to easily slip away and disengage from this type of trapping device. The trapping/restraining member of the present invention forms an acute angle with the club portion of the baton thereby providing a secure area from which the opponent's body parts cannot readily escape.

U.S. Pat. No. 4,703,932 issued Nov. 3, 1987 to Kubota also describes a side handle baton. In the Kubota device, a short shaft has been added to the free end of the cross handle for the purpose of improving the trapping/restraining capabilities of a standard cross handle baton. While this short shaft on the free end of the cross handle does improve the trapping ability of Kubota, this device lacks the higher level of effectiveness and safety of the present invention. The short shaft of Kubota is much more likely to gouge the flesh of an opponent thereby causing an unintended injury. The acute angle of the trapping member of the present invention allows more room for error on the part of the user. When pressure is applied to an appendage with the trapping member of the present invention, in view of the smoothness and the acute angle of this member, the appendage slides naturally into the secure "V" shaped area with minimum chance of error or injury.

The device of the Kubota patent as well as other cross handle batons of the prior art have other limitations in their use. With the device of the present invention, an unlimited number of holds and restraints can be performed. All such restraints are accomplished while gripping the device of the present invention in the primary grip area located within the protected hand guard. The user of the baton of the present invention does not have to remove his or her hand from the primary grip area and place it on the extended end of the baton to make best use of the trapping features In many situations, the releasing and regripping of a baton in order to perform a restraining/trapping movement is both dangerous and inefficient. The device of the present invention thus provides distinct advantages over batons of the prior art.

The baton of the present invention provides a combination of features neither taught nor suggested in the prior art including 1. a side guard for protecting the user's hand which has a small rotatable bushing attached thereto for facilitating maneuverability of the baton; 2. a hand guard for protecting the user's hand, the front portion of which also functions as a gripping area; and 3. a trapping member which is angulated towards the club portion of the baton to facilitate restraining parts of an opponent's body while causing as little injury as possible.

BRIEF SUMMARY OF THE INVENTION

The device of the invention includes an elongated generally cylindrical club portion with a hand guard surrounding the handle of the club to form a generally rectangular configuration therewith. Incorporated into one side of the hand guard is a trapping member, this trapping member extending away from the club portion at an acute angle relative thereto. This trapping member has a tip which extends beyond the perimeter of the hand guard and operates in conjunction with the club portion to trap or restrain portions of an opponent's body or weapons such as bats, pipes, sticks and the like. A side guard extends generally normally from the top of the handle in a directly generally opposite to that of the hand guard which protects the user's hand and facilitates a more secure and more controllable gripping of the baton. This side guard has a rotatable bushing thereon such that when the bushing is grasped between the user's thumb and index finger, in the web of the hand, the baton can readily be rotated and maneuvered into a different position. The side guard further has a dome shaped top which helps protect the user's hand. It is to be noted that the side guard is too small to grip in the user's hand and is not used to facilitate striking motions.

DETAILED DESCRIPTION OF THE INVENTION

Figure 1:
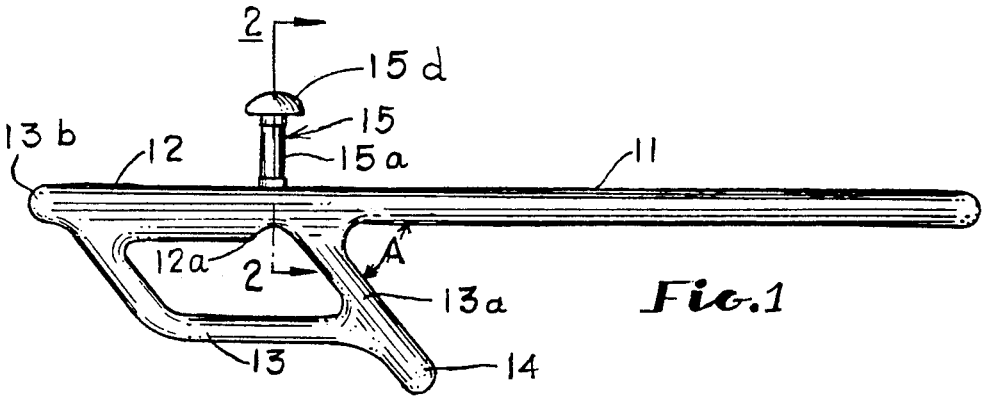
FIG. 1 is a side elevational view of a preferred embodiment of the invention.
Figure 2:
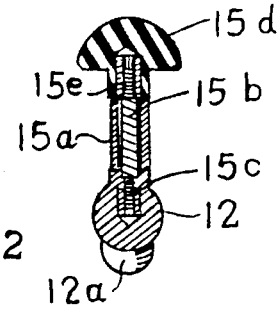
FIG. 2 is a cross sectional view taken along the plane indicated by 2—2 in FIG. 1.

Referring now to FIGS. 1 and 2, a preferred embodiment of the invention is illustrated. The baton has an elongated club portion 11 which is substantially cylindrical. Handle member 12 extends from one end of the club portion and has a generally elliptical lateral cross section contoured to accommodate the user's grip. A recess 12*a* is provided in the handle member to receive the user's forefinger to facilitate gripping in different positions, particularly by persons with smaller hands. Hand guard 13 forms a rectangular perimeter with handle 12 and thus provides protection for the user's hand. The forward portion 13*a* of the hand guard runs at an acute angle "A" towards club portion 11. Angle "A" may be between 35 and 80 degrees with an optimum value being about 55 degrees. Extending from hand guard portion 13*a* at the same angle relative to the club portion is a trapping tip 14. As to be explained in connection with FIG. 4, hand guard portion 13*a* and trapping tip 14 operate in conjunction with club portion 11 to form an effective trap for blocking weapons and restraining portions of an opponent's body. The inside of portion 13*a* is narrower than trapping tip 14 and tapered therefrom. The inside hand guard portion is used to facilitate a more secure grip as shown, for example in FIG. 5. The angulated configuration tends to avoid a sharp pressure or blow against the body in effecting such restraint and thus lessens the chance of injury to the person being restrained. An end tip 13*b* is provided on the end of the hand guard to afford further protection for the hand and for use as a striking point.

Extending normally from the side surface of club portion 11 and in a direction generally opposite to that in which the hand guard extends and substantially coplanar therewith is a side guard 15. Side guard 15 has a bushing 15*a* which is rotatably supported on shaft 15*b*. Shaft 15*b* is fixedly attached at one end thereof to handle 12 by means of a threaded screw portion 15*c* which threadably engages the handle 12. Shaft 15*b* may alternatively be molded to the handle. Shaped member 15*d* is fixedly attached to the other end of shaft 15*b* by means of a threaded screw portion 15*e* which threadably engages member 15*d*. Dome shaped member has rounded edges so as to minimize the likelihood of causing injury. Side guard 15 has the dual function of providing protection for the user's hand and facilitating the maneuvering of the baton, this by virtue of rotatable bushing 15*a*, the bushing being gripped between the thumb and forefinger in the web of the hand in effecting such maneuvering.

Figure 3:
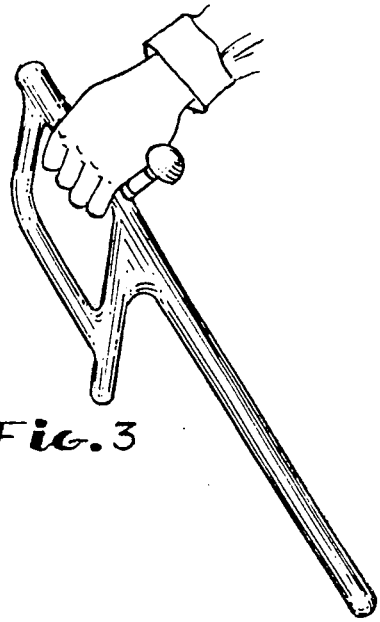
FIG. 3 is a perspective view illustrating the device of the invention being held by a user in a first position.
Figure 4:
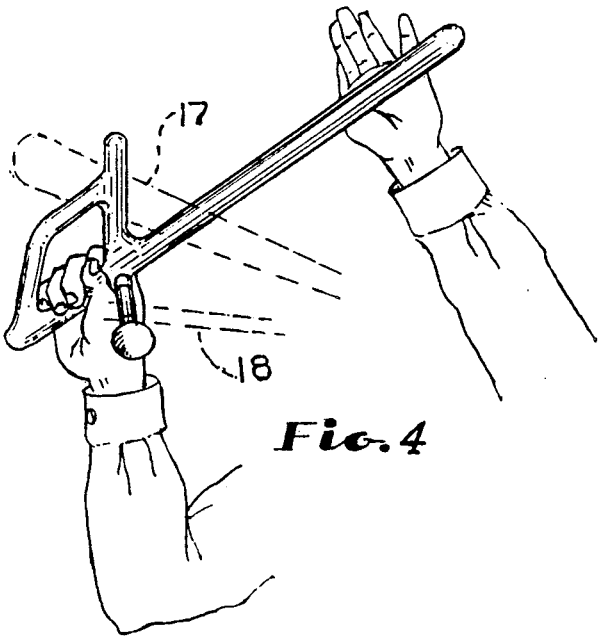
FIG. 4 is a perspective view illustrating the device of the invention being held by a user in a second position.
Figure 5:
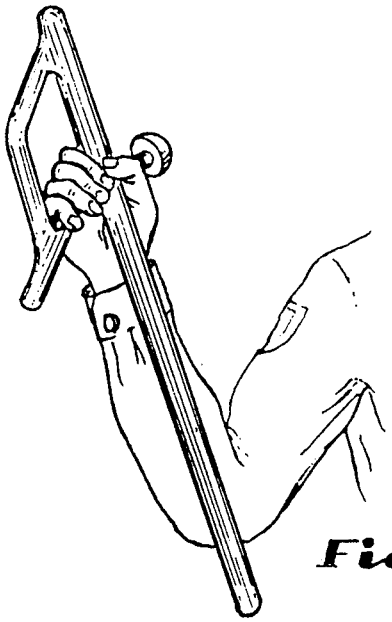
FIG. 5 is a perspective view illustrating the device of the invention being held by the user in a third position.

Referring now to FIGS. 3–5, the baton of the invention is shown as being used in three different positions. As already noted, the user can rapidly and easily maneuver the baton from one position to the other by using the rotatable bushing 15*a*.

As shown in FIG. 3, the baton is being held in an extended position with the fingers grasping the handle 12, the forefinger being within grooved portion 12*a*. This is the normal position employed for striking or protective action with the club portion. Many holds and restraints can be accomplished from this position. As can be seen, the hand guard 13 and side guard 15 provide substantial protection for the user's hand.

In FIG. 4, the baton is shown in the two hand hold position for blocking weapons. As shown in the FIG. 4, a weapon such as a bat 17 is trapped in the trapping member with the hand guard protecting the user's hand. As also shown, a weapon such as a stick or pipe 18 is prevented from striking the user's hand by the side guard. The baton can also be used in this position to restrain crowds in a non offensive manner.

In FIG. 5, the baton is shown in the forearm position with the user's forefinger extended along the rear of the handle. With the web of the hand firmly against the side guard and the three remaining fingers firmly gripping the inside portion of the hand guard/trapping area 13*a* and by gripping the inside portion of the handguard/-trapping area, the elongated club portion 11 is brought tightly against the user's arm. This provides substantial protection for the user's arm against hard objects such as bats, sticks and pipes. This position also provides positive and improved control over the baton when striking or when performing holds and restraints on an opponent. This is due to the leverage that is created when two opposite sides of the baton are forced together. This leverage is created by the pressure of the web of the hand upwardly against the side guard and the downward pressure of the fingers pulling aginst the inside portion of the hand guard/trapping area 13*a*.

The device of the invention thus provides a simply constructed baton which has great versatility, provides excellent protection for the user's hand and which is highly maneuverable for use in one position or another as the situation may dictate.

While the invention has been described and illustrated in detail, it is to be clearly understood that this is intended by way of illustration and example only and is not to be taken by way of limitation, the scope of the invention being limited only by the terms of the following claims.

I claim:

1. A police baton comprising:

a substantially cylindrical club portion having forward and rear ends, a main handle for said club portion extending substantially longitudinally therefrom, and having forward and rear ends, the forward end of said handle being joined to the rear end of said club portion, a hand guard having forward and rear side arm portion extending from the forward and rear ends of said main handle respectively and a longitudinal arm portion interconnecting said side arm portions and running opposite said main handle, said hand guard and main handle together being in the general configuration of a parallelogram, the forward side arm of said hand guard forming a trapping member running from the rear end of said club portion at an acute angle relative thereto, and a side guard extending substantially normally from said main handle in a direction away from said hand guard, said side guard including rotatable bushing means for facilitating the maneuvering of said baton and a dome shaped member at the end thereof for providing protection to the user's hand.

2. The baton of claim 1 wherein the acute angle at which the trapping member runs relative to said club portion is 35–80 degrees.

3. The baton of claim 1 wherein the acute angle at which the trapping member runs relative to said club portion is substantially 55 degrees.

4. The baton of claim 1 and further including a recess formed in said handle for receiving a finger of a user.

5. The baton of claim 1 and further including a trapping it extending longitudinally from the forward side arm portion.

* * * * *